US009513011B2

(12) United States Patent
Carlson

(10) Patent No.: US 9,513,011 B2
(45) Date of Patent: Dec. 6, 2016

(54) GAS TURBINE ENGINE COMBUSTOR TOP HAT COVER ATTACHMENT SYSTEM WITH LUGGED INTERLOCKING BACKING PLATE

(71) Applicant: Siemens Energy, Inc., Orlando, FL (US)

(72) Inventor: Andrew Carlson, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 358 days.

(21) Appl. No.: 14/294,451

(22) Filed: Jun. 3, 2014

(65) Prior Publication Data

US 2015/0345792 A1 Dec. 3, 2015

(51) Int. Cl.
*F23R 3/28* (2006.01)

(52) U.S. Cl.
CPC ..... *F23R 3/283* (2013.01); *F23R 2900/00017* (2013.01); *Y10T 29/49325* (2015.01); *Y10T 29/49734* (2015.01)

(58) Field of Classification Search
CPC combination set(s) only.
See application file for complete search history.

(56) References Cited

U.S. PATENT DOCUMENTS 1,613,926 A * 1/1927 Bropson ..... E03D 11/16 285/56
4,907,301 A * 3/1990 Tucker ..... E03D 11/16 285/56
5,582,077 A * 12/1996 Agram ..... F01D 5/027 403/318
5,890,239 A * 4/1999 Hite ..... E03D 11/16 285/56
7,334,960 B2 * 2/2008 Glessner ..... F16B 5/10 285/376
8,925,331 B2 * 1/2015 Carrere ..... F23R 3/002 403/348

* cited by examiner

*Primary Examiner* — David Walczak

(57) ABSTRACT

Combustor top hat covers are attached to midframe combustor portals with a lugged backing plate that interlocks with mating recesses formed in the corresponding midframe combustor portal. Exemplary embodiments utilize twist lock engagement of backing plate ring lugs under projecting tabs formed over a lug raceway recess in the combustor portal mating surface. The top hat cover is in turn fastened to the combustor portal by fasteners that engage corresponding threaded apertures formed in the backing plate.

14 Claims, 3 Drawing Sheets

GAS TURBINE ENGINE COMBUSTOR TOP HAT COVER ATTACHMENT SYSTEM WITH LUGGED INTERLOCKING BACKING PLATE

BACKGROUND OF THE INVENTION

1. Field of the Invention

The invention relates to gas turbine engine combustor top hat cover attachment systems. More particularly, embodiments of the invention incorporate lugged backing plates that interlock with mating recesses formed in the corresponding midframe combustor portal. The top hat cover is in turn fastened to the combustor portal by top hat cover fasteners that engage the corresponding threaded apertures formed in the backing plate.

2. Description of the Prior Art

Referring to FIGS. 1 and 2 an exemplary industrial gas turbine engine 10 is shown. The exemplary engine 10 includes a compressor section 12, a combustor section 14, a turbine section 16, and an exhaust section or system 18. The combustor section 14 includes a plurality of combustors 20 that are arrayed about a combustor midframe 22. Each combustor 20 is communication with the combustor section 14 interior via a corresponding combustor portal 23. Each combustor 20 has a "top hat" cover 24 that is affixed to a combustor portal mating surface 26. The combustor portal mating surface 26 has an array of threaded apertures 27 about its circumference that are aligned coaxially with a top hat flange 28 and its array of corresponding through hole apertures 29. The top hat cover flange 28 is then affixed to combustor portal 23 by passing top hat cover fasteners 30 through the through hole apertures 29, which then engage the corresponding combustor portal mating surface threaded apertures 27.

A typical known engine 10 has sixteen combustors 20. Each typical known combustor top hat cover 24 is affixed to the combustor midframe with twenty-four threaded fasteners. Thus, a typical known gas turbine engine 10 requires formation of approximately 384 threaded apertures 27 during its midframe manufacture. The aperture holes 27 must be drilled with relatively precise coaxial and circumferential alignment, on a large and relatively complex three dimensional midframe 22 fabrication. Each of those drilled holes is then hand threaded. Damage repair of any of the threaded apertures 27 formed in the midframe 22—whether damage is incurred during initial fabrication or discovered during subsequent service inspection of the engine 10—is labor intensive, complex and time consuming. Lost time during service outages potentially delays resumption of the turbine engine 10 power generation operation.

SUMMARY OF THE INVENTION

Accordingly, a suggested object of the invention is to reduce or eliminate the turbine engine manufacturing step of forming threaded apertures in the combustor mid frame that have been necessary for combustor top hat cover attachment to a corresponding combustor portal.

Another suggested object of the invention is to eliminate the need to repair damaged threaded apertures in the combustor midframe, such as in the combustor portal mating surface, that retain combustor top hat cover fasteners.

These and other objects are achieved in one or more embodiments of the invention by attaching combustor top hat covers to midframe combustor portals with a lugged backing plate that interlocks with mating recesses formed in the corresponding midframe combustor portal. Exemplary embodiments utilize twist lock engagement of backing plate ring lugs under projecting tabs formed over a lug raceway recess in the combustor portal mating surface. The top hat cover is in turn fastened to the combustor portal by fasteners that engage corresponding threaded apertures formed in the backing plate. In exemplary embodiments of the invention he threaded aperture backing plate reduces or eliminates the need to form threaded apertures directly in the combustor midframe. Furthermore, the backing plate is replaceable during engine service outages in the event that a damaged threaded aperture is discovered during engine service. The damaged backing plate can be scrapped or alternatively repaired more easily than attempting to repair a damaged aperture in situ within a combustor midframe.

Exemplary embodiments of the invention feature a backing plate for affixing a combustor top hat cover to a midframe combustor portal of a gas turbine engine. The backing plate comprises a ring, including a plurality of projecting ring lugs, which is adapted for locking mating insertion into corresponding recesses formed within a gas turbine engine midframe combustor port. The backing plate defines an array pattern of threaded holes that correspond to an array pattern of top hat cover fastener apertures, which are adapted for capture of top hat cover fasteners.

Other exemplary embodiments of the invention feature a gas turbine engine combustor top hat cover attachment system. The attachment system includes a combustor section midframe defining a combustor portal. A combustor portal mating surface circumscribes an outwardly exposed periphery of the combustor portal. The mating surface defines an array of projecting tabs that are separated by lug recesses. A lug raceway is defined within the combustor portal mating surface beneath the projecting tabs, which is in communication with the lug recesses. A first array pattern of through hole apertures is defined in the combustor portal mating surface that correspond to an array pattern of combustor top hat cover fastener apertures. A backing plate having a ring, including a plurality of projecting ring lugs, is adapted for interlocking engagement with the combustor portal mating surface by insertion of the ring lugs into the lug recesses and rotation of the ring lugs in the lug raceway under the projecting tabs in a twist lock fashion. The backing plate defines a second array pattern of threaded apertures that correspond to an array pattern of top hat cover fastener apertures. The second array of threaded apertures is adapted for coaxial alignment with the first array corresponding through hole apertures and capture of top hat cover fasteners.

Additional exemplary embodiments of the invention feature a method for attaching a gas turbine engine combustor top hat cover to a combustor section midframe combustor portal. The method is practiced by providing a combustor section midframe defining a combustor portal with a combustor portal mating surface circumscribing an outwardly exposed periphery of the combustor portal. The provided mating surface defines an array of projecting tabs that are separated by lug recesses. A lug raceway is defined within the combustor portal mating surface beneath the projecting tabs that is in communication with the lug recesses. A first array pattern of through hole apertures is defined in the combustor portal mating surface that correspond to an array pattern of combustor top hat cover fastener apertures. In the method a backing plate is provided, having a ring, including a plurality of projecting ring lugs, that is adapted for interlocking engagement with the combustor portal mating surface by insertion of the ring lugs into the lug recesses and rotation of the ring lugs in the lug raceway under the projecting tabs. The provided the backing plate defines a second array pattern of threaded apertures that correspond to an array pattern of top hat cover fastener apertures. The second array of threaded apertures is adapted for coaxial alignment with the first array corresponding through hole apertures and capture of top hat cover fasteners. The provided backing plate is inserted into the combustor portal mating surface, so that the ring lugs pass through the lug recesses. The inserted backing plate is rotated so that the lugs are oriented under the projecting tabs. The first and second aperture arrays are coaxially aligned. A top hat cover having a third array pattern of apertures corresponding to the first and second array patterns of apertures is provided and the third array pattern of apertures is coaxially aligned with the first and second aperture arrays. Top hat cover fasteners are passed through the third and second array pattern of apertures and they engage the corresponding threaded apertures of the first array pattern of apertures.

The respective objects and features of the invention may be applied jointly or severally in any combination or subcombination by those skilled in the art.

BRIEF DESCRIPTION OF THE DRAWINGS

The teachings of the invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will realize that exemplary embodiments of the present invention can be readily utilized in attachment of combustor top hat covers to combustor portal mating surfaces with top hat cover fasteners but without the need to form threaded fastener apertures in the combustor midframe (such as in the portal mating surface) that have been previously needed to engage and anchor those fasteners. The invention interposes a backing plate between the top hat cover flange and the combustor portal mating surface that incorporates the threaded apertures needed for anchoring the top hat cover fasteners. The backing plate has ring lugs that are inserted in a lug raceway and that are engaged under projecting tabs formed in combustor portal mating surface, such as by a "twist lock" motion analogous to a bolt action rifle bolt engagement in a corresponding lug raceway formed in the rifle receiver. It is easier to drill and tap threaded fastening apertures in the backing plate than in the combustor midframe during their initial fabrication. If at any time any of the backing plate threaded apertures are damaged, the entire backing plate can be disengaged from the combustor midframe mating surface by reverse unlocking twist and replaced with an undamaged backing plate.

Figure 1:
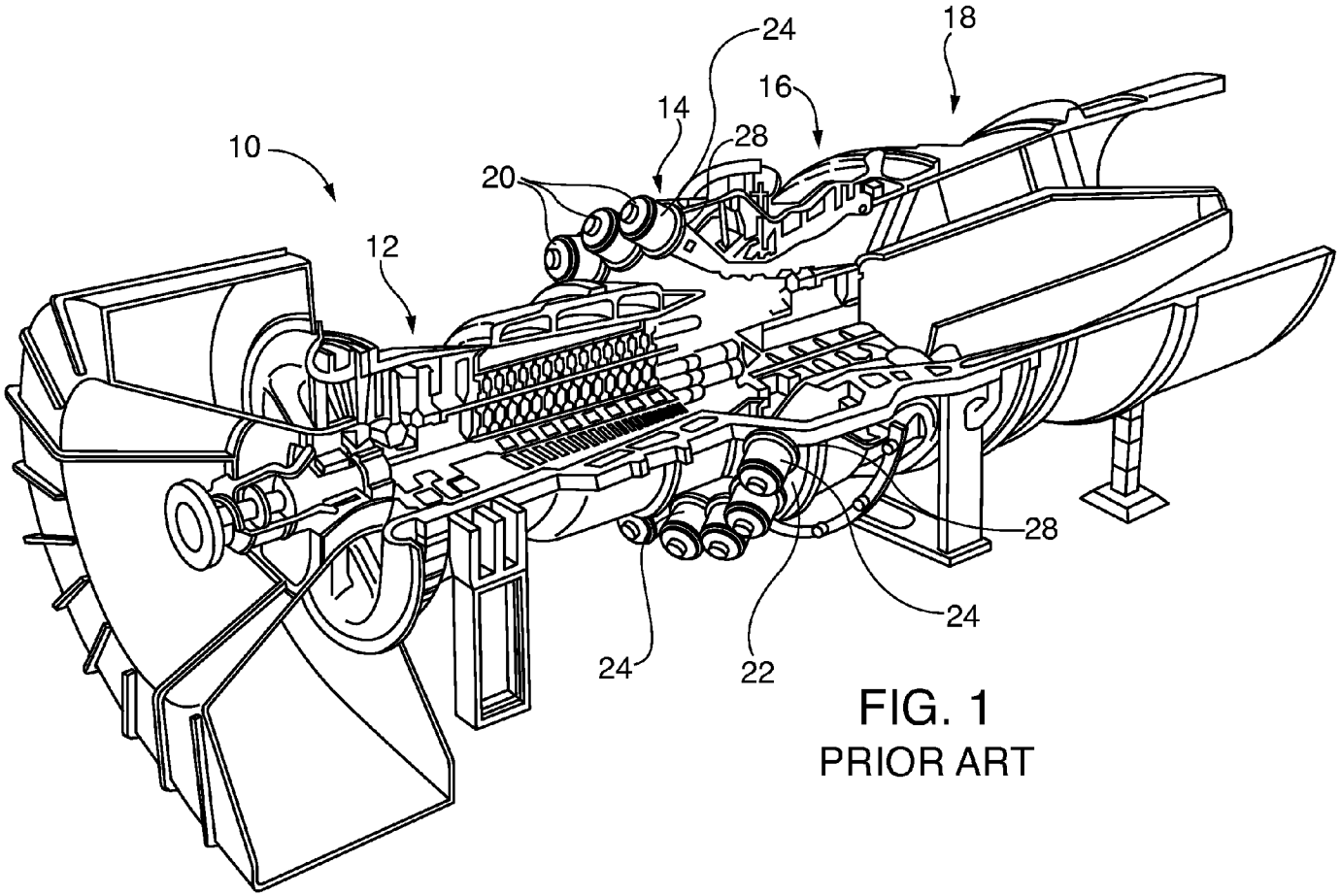
FIG. 1 PRIOR ART
FIG. 1 is a perspective view of a known combustion gas turbine engine.
Figure 2:
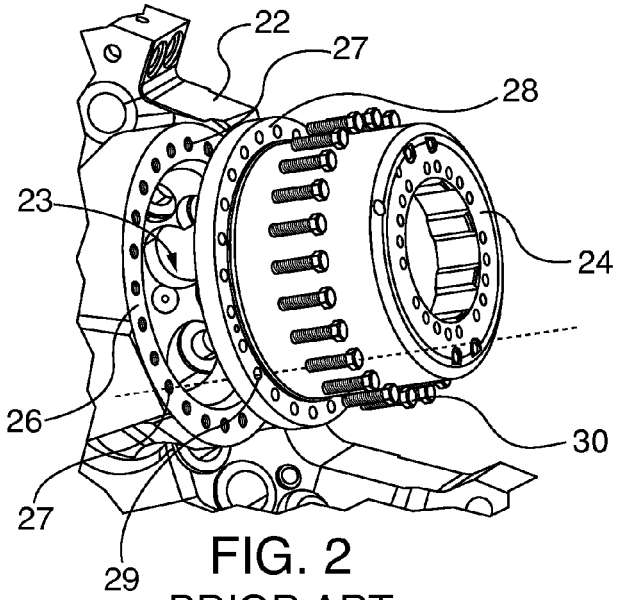
FIG. 2 PRIOR ART
FIG. 2 is a perspective view of a known combustor top hat cover fastening interface having an array of threaded apertures formed in the combustor midframe.
Figure 3:
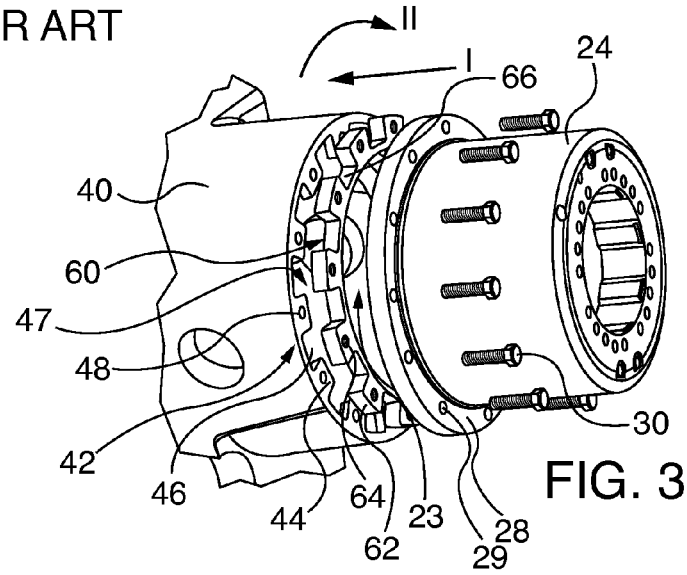
FIG. 3 is a perspective exploded view of a combustor top hat cover attachment system in accordance with an exemplary embodiment of the invention.
Figure 4:
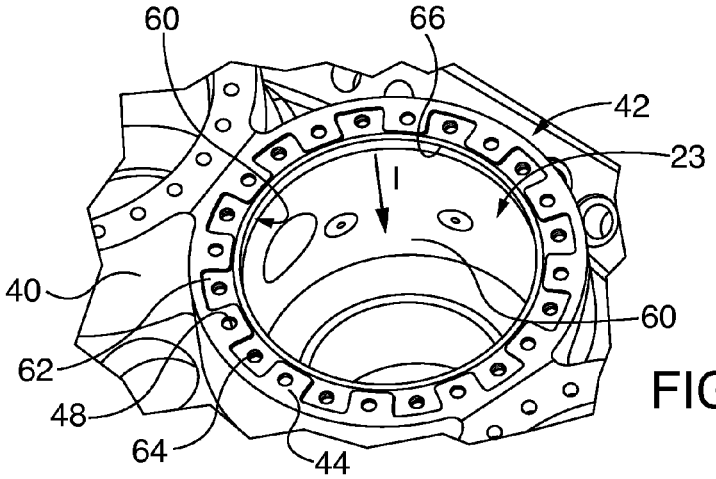
FIG. 4 is a perspective plan view of a combustor portal mating surface of the invention embodiment of FIG. 3 upon initial axial insertion (arrow I) a backing plate therein.
Figure 5:
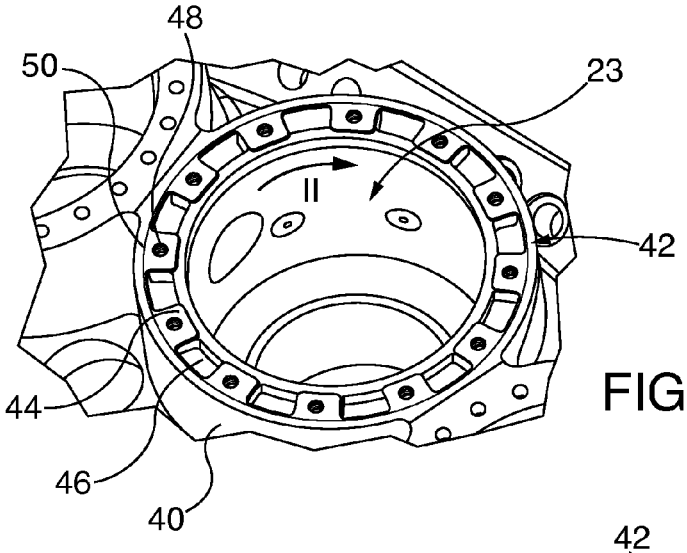
FIG. 5 is a perspective plan view of a combustor portal mating surface of the invention embodiment of FIG. 4 after twist-lock rotation (arrow II) of the backing plate therein.

Referring to FIGS. 3-5, in accordance with an exemplary embodiment of the invention a combustor midframe 40 has a combustor portal 23 for receipt of a combustor assembly (not shown), which in turn is covered by a combustor cover top hat 24. The combustor top hat 24 is of known construction and includes a mounting top hat flange 28 with an array of through hole apertures 29 that receive top hat cover fasteners 30.

Figure 7:
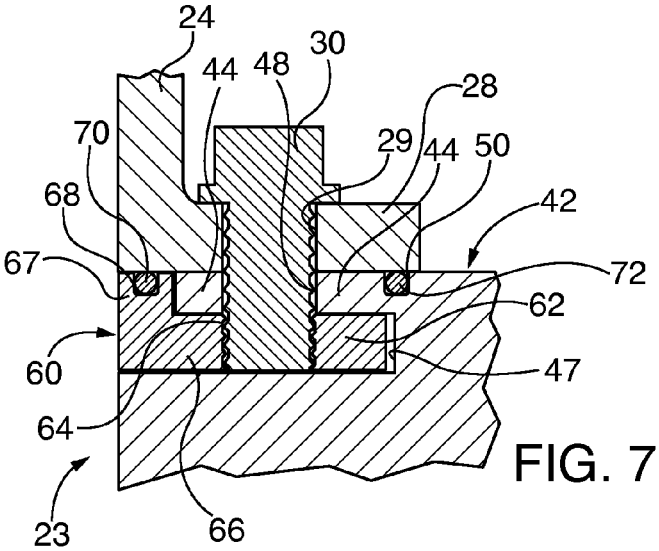
FIG. 7 is a fragmented cross sectional view of the combustor top hat cover attachment system of FIG. 6.

As shown in FIGS. 4 and 7, the midframe 40 has a combustor portal mating surface 42 that circumscribes the combustor portal 23. The combustor mating surface 42 includes circumferentially spaced projecting tabs 44 that are separated by lug recesses 46 and a circumferential oriented lug raceway 47 under the projecting tabs. The projecting tabs 44 define an array pattern of tab through hole apertures 48 that correspond to the array pattern of apertures 29 that are formed in the top hat cover flange 28. Optionally a circumferential groove 50 is formed in the combustor portal mating surface 42 for receipt of an outer static seal 72. When utilized, one or more static seals can provide additional sealing assistance between the top hat cover 24 and the combustor portal mating surface 42.

Referring generally to FIGS. 3-7, a backing plate 60 is interposed between the top hat cover flange 28 and the combustor portal mating surface 42. The backing plate 60 has a ring 66 and a plurality of radially outwardly projecting ring lugs 62 that are adapted for twist lock-like interlocking engagement with the combustor portal mating surface 42. The interlocking is accomplished by insertion of the ring lugs 62 into the lug recesses 46 between the projecting tabs 44 (see arrow I in FIGS. 3 and 4) and rotation of the backing plate 60 (see arrow II in FIGS. 3 and 5) within the lug raceway 47, so that the ring lugs are now under the projecting tabs 44. The backing plate 60 defines an array pattern of threaded apertures 64 that also correspond to the previously described respective aperture array patterns of top hat cover fastener apertures 29 and tab apertures 48. As shown in FIG. 7, the through apertures 29 and 48 are in coaxial alignment with the backing plate threaded apertures 64, so that the top hat cover fasteners 30 can be threaded into mating engagement with the backing plate threaded apertures. Optionally the backing plate may include an upstanding ring skirt 67 that defines a seal groove 68 for receipt of an inner static seal 70, similar to the previously described outer static seal 72.

Figure 6:
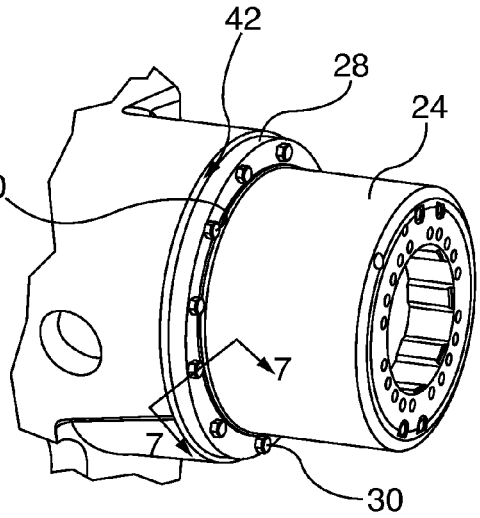
FIG. 6 is a perspective view of an assembled combustor top hat cover attachment system in accordance with a second exemplary embodiment of the invention.

The backing plate 60 and top hat cover 24 are installed on the combustor midframe 40 over the combustor portal 23 by inserting the backing plate into the combustor portal mating surface 42, so that the ring lugs 62 pass through the corresponding lug recesses 46 and into the lug raceway 47 (see the arrow I insertion direction). Next, the inserted backing plate 60 is rotated so that the ring lugs 62 are oriented under the projecting tabs 44, so that the paired aperture arrays 48 and 64 are coaxially aligned. The top hat cover 24 is placed over the interlocked portal mating surface 42 and backing plate 60, so that its array of top hat flange through holes 29 are coaxially aligned with the paired aperture arrays 48 and 64. As shown in FIGS. 6 and 7, the top hat cover fasteners 30 are then passed through hole apertures 29 and 48 where their external male threads engage the corresponding backing plate 60 threaded apertures 64. The installation procedure is reversed to remove a backing plate 60, which if damaged, can be replaced with another undamaged backing plate.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A gas turbine engine combustor top hat cover attachment system, comprising:

a combustor section midframe defining a combustor portal;

a combustor portal mating surface circumscribing an outwardly exposed periphery of the combustor portal, the mating surface defining an array of projecting tabs that are separated by lug recesses;

a lug raceway defined within the combustor portal mating surface beneath the projecting tabs that is in communication with the lug recesses;

a first array pattern of through hole apertures defined in the combustor portal mating surface that correspond to an array pattern of combustor top hat cover fastener apertures; and a backing plate having a ring, including a plurality of projecting ring lugs, that is adapted for interlocking engagement with the combustor portal mating surface by insertion of the ring lugs into the lug recesses and rotation of the ring lugs in the lug raceway under the projecting tabs, the backing plate defining a second array pattern of threaded apertures that correspond to an array pattern of top hat cover fastener apertures, the second array of threaded apertures adapted for coaxial alignment with the first array corresponding through hole apertures and capture of top hat cover fasteners.

2. The attachment system of claim 1, the ring lugs projecting radially outwardly from an outer circumference of the ring and the projecting tabs projecting radially inwardly from the combustor portal mating surface.

3. The attachment system of claim 2, further comprising the first array pattern of apertures defined in the projecting tabs and the second array pattern of apertures defined in the ring lugs.

4. The attachment system of claim 3, further comprising the ring or the combustor portal mating surface or both defining a ring seal groove on an outer axial surface thereof, for receipt of a top hat cover static seal.

5. The attachment system of claim 1, further comprising the ring or the combustor portal mating surface or both defining a ring seal groove on an outer axial surface thereof, for receipt of a top hat cover static seal.

6. The attachment system of claim 1, further comprising a top hat cover having a third array pattern of apertures corresponding to the first and second array patterns of apertures, the third array pattern of apertures adapted for passage of top hat cover fasteners therethrough and retention of the top hat cover on the combustor section midframe.

7. The attachment system of claim 6, the ring lugs projecting radially outwardly from an outer circumference of the ring and the projecting tabs projecting radially inwardly from the combustor portal mating surface.

8. The attachment system of claim 7, further comprising the ring or the combustor portal mating surface or both defining a ring seal groove on an outer axial surface thereof, for receipt of a top hat cover static seal.

9. The attachment system of claim 8, further comprising a top hat cover static seal in the ring seal groove.

10. The attachment system of claim 6, further comprising the ring or the combustor portal mating surface or both defining a ring seal groove on an outer axial surface thereof, for receipt of a top hat cover static seal.

11. The attachment system of claim 10, further comprising a top hat cover static seal in the ring seal groove.

12. A method for attaching a gas turbine engine combustor top hat cover to a combustor section midframe combustor portal, comprising:

providing a combustor section midframe defining a combustor portal with a combustor portal mating surface circumscribing an outwardly exposed periphery of the combustor portal, the mating surface defining an array of projecting tabs that are separated by lug recesses; a lug raceway defined within the combustor portal mating surface beneath the projecting tabs that is in communication with the lug recesses; a first array pattern of through hole apertures defined in the combustor portal mating surface that correspond to an array pattern of combustor top hat cover fastener apertures;

providing a backing plate having a ring, including a plurality of projecting ring lugs, that is adapted for interlocking engagement with the combustor portal mating surface by insertion of the ring lugs into the lug recesses and rotation of the ring lugs in the lug raceway under the projecting tabs, the backing plate defining a second array pattern of threaded apertures that correspond to an array pattern of top hat cover fastener apertures, the second array of threaded apertures adapted for coaxial alignment with the first array corresponding through hole apertures and capture of top hat cover fasteners;

inserting the backing plate into the combustor portal mating surface, so that the ring lugs pass through the lug recesses;

rotating the inserted backing plate so that the lugs are oriented under the projecting tabs;

coaxially aligning the first and second aperture arrays;

providing a top hat cover having a third array pattern of apertures corresponding to the first and second array patterns of apertures;

coaxially aligning the third array pattern of apertures with the first and second aperture arrays; and passing top hat cover fasteners through the third and second array pattern of apertures and engaging the fasteners with corresponding threaded apertures of the first array pattern of apertures.

13. The method of claim 12 further comprising replacing a backing plate by:

unfastening and retracting the top hat cover fasteners;

removing the top hat cover, exposing the a previously installed first backing plate;

disengaging the first backing plate from the combustor portal mating surface by twisting the cover plate so that the ring lugs are within the lug recesses and axially retracting the first backing plate; and engaging a second backing plate into the combustor portal mating surface by inserting and rotating said second backing plate.

14. The method of claim 13, the second backing plate comprising a repaired threaded aperture in the second array pattern of apertures.

* * * * *